US010618854B2

(12) United States Patent
Anderson et al.

(10) Patent No.: US 10,618,854 B2
(45) Date of Patent: Apr. 14, 2020

(54) STABILITY OF GAS ATOMIZED REACTIVE POWDERS THROUGH MULTIPLE STEP IN-SITU PASSIVATION

(71) Applicant: Iowa State University Research Foundation, Inc., Ames, IA (US)

(72) Inventors: Iver E. Anderson, Ames, IA (US); Andrew D. Steinmetz, Peoria, IL (US); David J. Byrd, Boone, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 282 days.

(21) Appl. No.: 15/731,136

(22) Filed: Apr. 24, 2017

(65) Prior Publication Data

US 2017/0305808 A1 Oct. 26, 2017

Related U.S. Application Data

(62) Division of application No. 13/986,193, filed on Apr. 10, 2013, now Pat. No. 9,650,309.

(60) Provisional application No. 61/686,822, filed on Apr. 12, 2012.

(51) Int. Cl.

| | |
|---|---|
| ***C06B 45/30*** | (2006.01) |
| ***B22F 9/16*** | (2006.01) |
| ***B22F 1/00*** | (2006.01) |
| ***B22F 9/08*** | (2006.01) |

(52) U.S. Cl.

CPC ..... *C06B 45/30* (2013.01); *B22F 1/0088* (2013.01); *B22F 9/082* (2013.01); *B22F 9/16* (2013.01); *B22F 2009/0844* (2013.01); *B22F 2999/00* (2013.01)

(58) Field of Classification Search

CPC ..... C06B 45/30; B22F 9/16

See application file for complete search history.

(56) References Cited

U.S. PATENT DOCUMENTS

| | | | | |
|---|---|---|---|---|
| 1,972,317 A | | 9/1934 | Reimers | 75/17 |
| 4,992,337 A | | 2/1991 | Kaiser et al. | 428/642 |
| 5,125,574 A | * | 6/1992 | Anderson | B22F 9/082 239/397.5 |
| 5,368,657 A | | 11/1994 | Anderson | 148/400 |
| 5,372,629 A | | 12/1994 | Anderson | 75/332 |
| 5,589,199 A | | 12/1996 | Anderson | 425/10 |

(Continued)

OTHER PUBLICATIONS

J.W. Fruehling, Protective Atmospheres for Molten Magnesium, PhD Thesis University of Michigan 1970.

(Continued)

*Primary Examiner* — Aileen B Felton

(57) ABSTRACT

A method for gas atomization of oxygen-reactive reactive metals and alloys wherein the atomized particles are exposed as they solidify and cool in a very short time to multiple gaseous reactive agents for the in-situ formation of a protective reaction film on the atomized particles. The present invention is especially useful for making highly pyrophoric reactive metal or alloy atomized powders, such as atomized magnesium and magnesium alloy powders. The gaseous reactive species (agents) are introduced into the atomization spray chamber at locations downstream of a gas atomizing nozzle as determined by the desired powder or particle temperature for the reactions and the desired thickness of the reaction film.

6 Claims, 9 Drawing Sheets

(56) References Cited

U.S. PATENT DOCUMENTS

| | | | | |
|---|---|---|---|---|
| 5,811,187 | A | 9/1998 | Anderson | 428/403 |
| 6,533,563 | B1 | 3/2003 | Otaigbe | 425/6 |
| 2009/0025841 | A1 | 1/2009 | Smith | 149/108.2 |

OTHER PUBLICATIONS

S.P. Cashion et al., Characterisation of protective surface films formed on molten magnesium protected by air/SF6 atmopsheres, Journal of Light Metals 2, 2002.
Gunnar Petterson et al, Characterisation of the surface films forme on molten magnesium in different protective atmospheres, Materials science and Engineering, A332, 2002.
Alan M. Russell at al, Structure-Property Relations in Nonferrous Metals, John Wiley & Sons, Inc., 2005, 0-471064952-X.
P. K. Sokolowski, Processing and protection of rare earth permanent magnet particualte for bonded magnet applications, MS Thesis, Iowa State University, 2007.
Striko Dynarad, Safe Handling of Magnesium, Mar. 2010, StrikoDynarad Corporation.
Magnesium Elecktron, Atomized Magneisum Powders, Data Sheet: 345.
Valimet, Inc. Preliminary Design of Plant for Spherical Magnesium Powder, Stockton, CA, 1996.
Sun-Mi Kim et al, Behavior of CaO coating of gas atmoized Mg powders using mechanical milling process, Journal of Alloys and Compounds, 509S, 2011.
N. B. Pilling et al, The Oxidation of Metals at High Temperatures, Journal of the Institute of Metals, pp. 529-592, 1923.
Earl. A. Gulbransen, The Oxidation and Evaporation of Magensium at Temperatures From 400 to 500 C, Symposium on Electrometallurgy, 1944 pp. 589-598.
O. Kubaschewski et al, Oxidation of Metals and Alloys, Academic Press, 1953, 1-11418-617-0.
T.E. Leontis et al, Rates of High-Temperature Oxidation of Magnesium and Magnesium Alloys, Metals Technology, pp. 265-295, 194.
G.J. Gregg et al, The High Temperature Oxidation of MMagnesium in Dry and in Moist Oxygen, Journal of the Institue of Metals, pp. 187-203, 1,1958.
S.P. Cashion et al, The mechanism of protection of molten magnesium by cover gas mixtures containing sulphur hexafluoride.
Shou-mei Xiong et al, Protection behavior of fluroine-containing cover gases on molten magnesium alloys, TransacTrans.2, 43-47, Metals Society of China, 20, 1228-1234, 2010.
James E. Hillis et al, The Internatinal Program to Identify Alternative to SF6 for Magnesium Melt Protection, The International Magnesium Assocation, Nov. 2002.
Iver E. Anderson et al, Highly Tuned Gas Atomization for Controlled Preparation of Coarse Powder, Materialwissenschaft und Werkstofftechnik, vol. 41, 2010.
David R. Gaskell, Introduction to the Thermodynmaics of Materials, Fourth Edition, New York, New York, Taylor & Francis Group, 2003 pp. 346-352.
M. Binnewies et al., Thermodynamic Data of Elements and Compounds Weinheim, Germany, Wiley VCH, 1999, pp. 466, 672, 673, 674.
I. Barin et al., Thermochemical Properties of Inorganic Substances, Berlin, Germany, Springer-Verlag, 1972, pp. 433-463.
P. Mathur et al., Analysis of the Spray Deposition Process, Acta Metallurgica, vol. 37, 1998.
DuPont Krytox Performance Lubricants, Product Overview, 2011.
William Braker et al., Matheson Gas Data Book, sixth edition, 1980, pp. 651.
Elizabeth Vileno et al. Thermal Decomposition of NF3 with Various Oxides, Chemical Materials, vol. 8, 1995, pp. 1217-1221.
J.J. Dunkley, Evaluating the Performance of Atomizers, Advances in Powder Metallurgy and Particulate Materials, vol. 2, 1998, pp. 1-7.
D.R. Poirier et al., Transport Phenomena in Materials Processing, Warrnedale, PA, The Minerals, Metals, & Materials Society, 1994 pp. 39-62 and 145-167.
I.E. Anderson et al., "Melt Feeding and Nozzle Design Modifications for Enhanced Control of Gas Atomization", Advances in Powder Metallurgy and Particulate Materials-2004, Metal Powder Industries Federation, 2004, part 2, pp. 26-36.
A. Lawley, Atomization: The Production of Metal Powders, MPIF, 1992 Metal Powders Industries Federation, 1992, pp. 1-11.
Frank P. Incropera, Introduction to Heat Transfer, slsl: Wiley, 2006, 7.1, pp. 365-431.

* cited by examiner

GA-1-182
Fluorinated Mg

Hart Metals
-325 mesh Mg

STABILITY OF GAS ATOMIZED REACTIVE POWDERS THROUGH MULTIPLE STEP IN-SITU PASSIVATION

RELATED APPLICATION

This application is a division of copending Ser. No. 13/986,193 filed Apr. 10, 2013, which claims benefit and priority of U.S. provisional application Ser. No. 61/686,822 filed Apr. 12, 2012, the entire disclosures of which are incorporated herein by reference.

CONTRACTUAL ORIGIN OF THE INVENTION

The United States Government has rights in this invention pursuant to Contract No. DE-AC02-07CH11358 between the U.S. Department of Energy and Iowa State University.

FIELD OF THE INVENTION

The present invention relates to gas atomization of reactive metals and alloys, including and especially magnesium and magnesium alloys, using multiple gaseous reactive agents for the formation of a protective reaction film or layer on gas atomized powders in a manner to increase powder stability, such as increase powder thermal ignition temperature as well as reduce spontaneous discharge by spark ignition.

BACKGROUND OF THE INVENTION

Magnesium powder is a critical component in a wide variety of applications. Magnesium powders have applications in numerous applications such as signal flares, fireworks, military illuminating and infrared countermeasure flares, propellants, and powder metallurgy. Gas atomized magnesium powders can be used for alloying aluminum and zinc, desulfurization of iron and steel, reduction of titanium through the Kroll process, and incendiaries. However, these powders are pyrophoric and must be handled carefully and kept dry at all times.

One manufacturer of magnesium powder in the United States uses a high pressure gas atomization procedure that utilizes helium doped with small quantities of oxygen as the atomization gas and is executed under an inert atmosphere to reduce (but not eliminate) the potential for dangerous pyrophoric reactions between the atomization gas and molten metal droplets and between the resulting powders and air or moisture (Valimet, Inc. "Preliminary Design of Plant for Spherical Magnesium Powder", Stockton, CA, 1996). Similar systems exist in other locations worldwide.

Similar reactivity issues affect the magnesium die-casting industry which has lead to extensive research on methods of protecting magnesium from spontaneous ignition during melting operations and suppressing magnesium vaporization resulting from the metal's extremely high vapor pressure. Recent studies have explored the ability of certain fluorine containing cover gases to protect molten magnesium in die casting operations from excessive vaporization and burning by excluding contact with air by flooding the top of the melt with argon "cover" gas or by modifying the native oxide (MgO) on the melt surface through interaction with these gas atmospheres. Sulfur hexafluoride gas is commonly used in the magnesium casting industry to protect molten magnesium from excessive oxidation and ignition.

SUMMARY OF THE INVENTION

The present invention involves gas atomization of reactive metals and alloys wherein the atomized particles are exposed as they solidify and cool in a very short time period to multiple gaseous reactive agents for the in-situ formation of a protective reaction film on the atomized particles. The present invention is especially useful for making highly pyrophoric reactive metal or alloy atomized powders that include, but are not limited to, atomized magnesium and magnesium alloy powders (henceforth collectively referred to as "magnesium" powders or particles). The gaseous reactive species (agents) are introduced into the atomization spray chamber at locations downstream of a gas atomizing nozzle as determined by the desired powder or particle temperature for the reactions and the desired thickness of the reaction film.

In an illustrative embodiment of the present invention, an exemplary first gaseous reactive species used for the in-situ passivation of the atomized magnesium powder comprises oxygen, which can be injected either at the same level or above the gaseous second reactive species in the atomization chamber. The second reactive species is incorporated into the oxide layer (reaction product) formed on the magnesium particles by the oxygen species in an amount to modify the oxide layer in a manner that increases the thermal ignition temperature and spark ignition resistance of the atomized particles. Exemplary second species include, but are not limited to, a halogen-containing gas, such as a fluorine-containing gas. In a particular illustrative embodiment for in-situ passivation of atomized magnesium powders, the second reactive gas comprises $SF_6$ for forming a fluorinated oxide compound as a layer covering the powder particles; however, any suitable passivating gas, such as $NF_3$, can be considered for use in conjunction with the reactive oxygen species in this illustrative method embodiment.

The present invention envisions atomized reactive metal or alloy powders that have a thin protective layer that comprises a reaction product, such as a compound, of a metal (e.g. Mg) and the first reactive species (e.g. oxygen) wherein the reaction product, such as the compound, also includes an amount of the second reactive species (e.g. fluorine) to improve ignition stability as described above such that the atomized powders are more resistant to ignition than a simple native oxide layer covered particle to reduce or perhaps substantially eliminate the chance of powder ignition during production, handling, storage, and further processing of such reactive powders to end-use shapes. The protective layer is formed on the atomized particles to a thickness of only ten's of nanometers and yet it imparts beneficial improved resistance to ignition to the atomized powder and may also provide improved resistance to humidity during storage. The invention envisions also controlling the particle size of the atomized particles as well as to provide a relatively small particle surface area to particle volume ratio (by a generally spherical shape) in order to further reduce risk of ignition Other advantages and features of the present invention will become more readily apparent from the following detailed description taken with the following drawings.

DETAILED DESCRIPTION OF THE INVENTION

Figure 1:
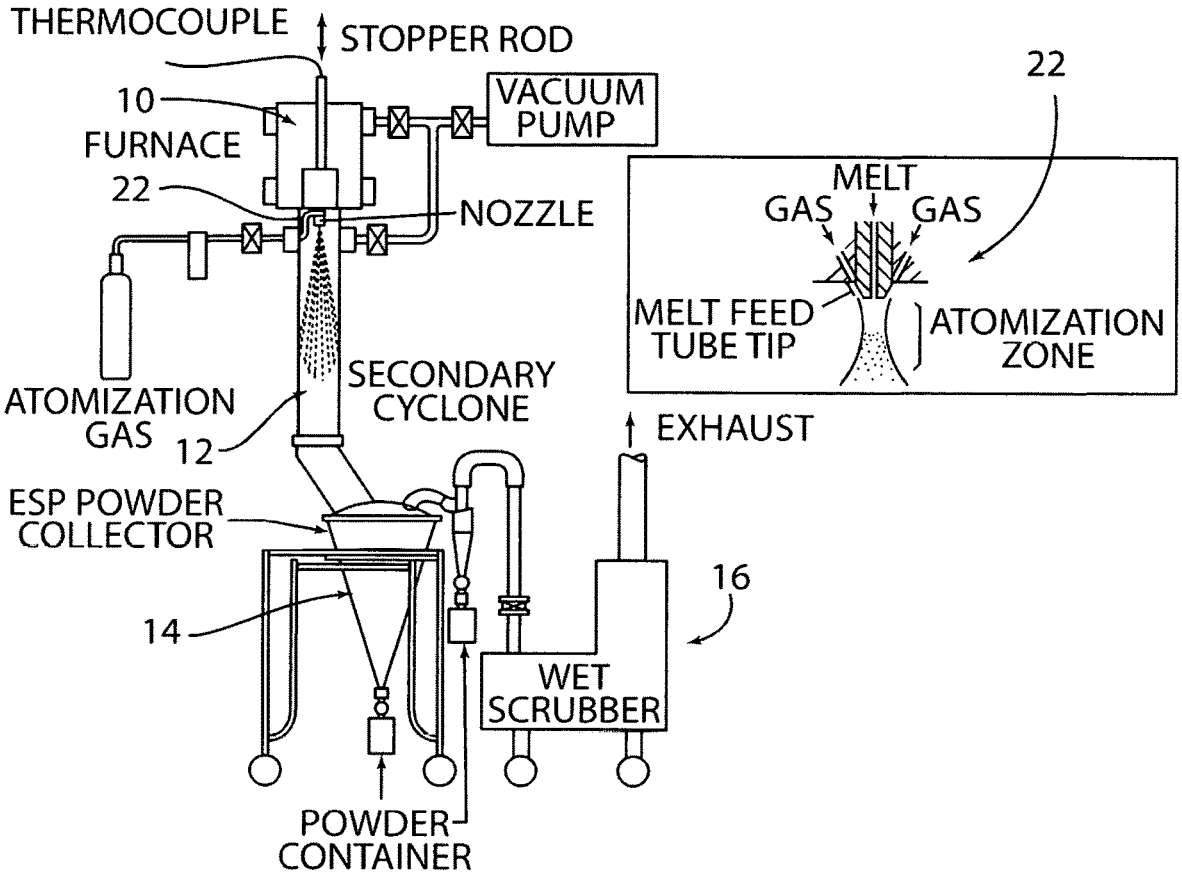
FIG. 1 is a schematic view of atomization apparatus, fitted with a narrow (30 cm diameter) spray chamber in this case, for practicing an embodiment of the present invention.

Although the present invention is described herebelow in connection with the in-situ passivation of gas atomized magnesium powders for purposes of illustration and not limitation, the present invention is not so limited and can be practiced to passivate gas atomized powders made of other oxygen-reactive metals and alloys such as calcium, lithium, strontium, vanadium and alloys thereof. Regardless of the metal or alloy powder being processed, the present invention involves gas atomization of the reactive metal or reactive alloy (referred to as reactive metallic material in the claims) wherein the atomized particles are exposed as they solidify and cool in the very short available time (e.g. fractions of a second) in an atomization spray chamber to multiple gaseous reactive agents for the in-situ formation of a protective reaction film on the atomized particles. The gaseous reactive species (agents) are introduced into the atomization chamber at locations downstream of a gas atomizing nozzle as determined by the powder metal or alloy composition, the desired powder or particle temperature for the reactions, and the desired thickness of the reaction film.

EXAMPLE

The following Example for making magnesium powder is offered to further illustrate but not limit the present invention:

Experimental Procedure

A modified high pressure gas atomization system (HPGA) located at the Ames laboratory, Ames, Iowa, was used for conducting low pressure gas atomization (LPGA) of magnesium to produce passivated magnesium powders in accordance with an illustrative embodiment of the present invention. The gas atomization system is generally as described in U.S. Pat. Nos. 5,372,629; 5,589,199; and 5,811,187, which are incorporated herein by reference and is shown schematically in FIG. 1. The basic gas atomization system includes a melting chamber 10, a drop tube (spray chamber) 12 beneath the melting chamber and which was 2 feet in diameter and approximately 9 feet tall, and a powder collection chamber 14 along with an exhaust cleaning system 16. The melting chamber 10 on top of the spray chamber 12 contained the melt system. The melt system included a melting crucible 18, stopper rod 20, and pour tube (not shown) of the type described and shown in FIG. 2 of U.S. Pat. No. 5,125,574, which is also incorporated herein by reference. The crucible, stopper rod, and pour tube were all made of mild steel for handling molten magnesium. A conventional water-cooled induction coil (not shown) was disposed around the crucible 18 to heat the magnesium charge in the crucible. The stopper rod 20 was pneumatically controlled. The pour tube was screwed into the bottom of the crucible 18 and then slipped into a stainless steel insert, which was then placed through the central orifice of the close coupled gas atomization nozzle 22 positioned just beneath the crucible 18 as described and shown in FIG. 2 of U.S. Pat. No. 5,125,574, which is incorporated herein by reference. Yttria paint was applied to the small gap between the pour tube and the crucible to prevent the melt from leaking out of the crucible. The crucible itself was wrapped in insulation and sat on an insulating block covered with a layer of refractory felt to protect the melting chamber itself and other components of the atomizer from excessive heating during the experiment.

The melting chamber 10 and main spray chamber 12 of the gas atomizing system were not isolated from each other by vacuum seals, but each had a pressure relief valve to prevent excessive buildup in either chamber section during a trial run. There was a viewport on the melting chamber to monitor the condition of the charge in the crucible 18 and confirm melting before lifting the stopper rod 20. Two more viewports were located near the top of the spray chamber 12 and were used to monitor melt break-up visually during atomization.

Molten magnesium metal exited from the pour tube and was immediately impinged by the atomization gas jets from a gas atomizing nozzle 22 of the close-coupled type as described in U.S. Pat. No. 5,125,574, which is incorporated herein by reference. The gas atomizing nozzle had a 14 degree jet apex angle, 30 discrete circular gas jets, and each jet having a diameter of 0.082 inches. High purity (HP) argon at low pressure (e.g. 70 psig) and a slotted trumpet bell pour tube (shown in: Otaigbe, J., McAvoy, J., Anderson, I. E., Ting, J., Mi, J., and Terpstra, R. L., "Atomizing Apparatus for Making Polymer and Metal Powders and Whiskers," U.S. Pat. No. 6,533,563, Mar. 18, 2003 and in: I. E. Anderson, D. Byrd, and J. L Meyer, "Highly Tuned Gas Atomization for Controlled Preparation of Coarse Powder," MATWER, vol. 41, no. 7 (2010), pp. 504-512, both of which are incorporated herein by reference) were used as the atomization gas to produce atomized powders with an average particle diameter of 500 microns. Also located at the top of the spray chamber 12, in a 6 inch diameter around the nozzle, was a gas curtain ring 30 made of ⅜ inch copper tubing. This ring had thirty-eight holes with diameters of 0.029 inch pointing down the spray chamber to push the atomized powder stream towards the middle of the spray chamber, preventing it from colliding with the spray chamber wall as quickly as it might otherwise. High purity (HP) argon was discharged from the gas curtain ring 30.

Figure 2:
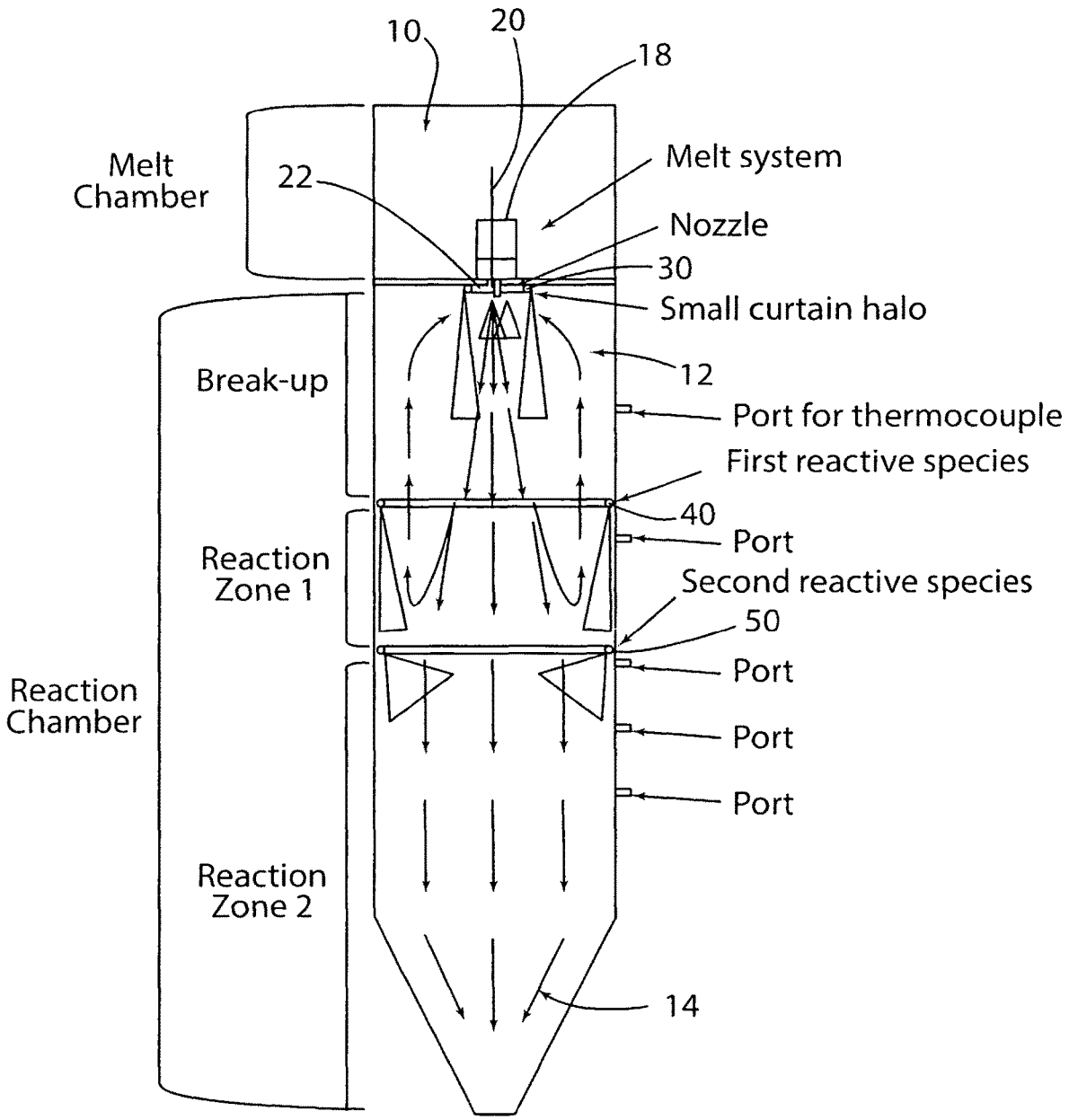
FIG. 2 is a schematic view of atomization apparatus, fitted with a larger (60 cm diameter) spray chamber in this case, showing first and second reactive species injection rings for practicing an embodiment of the present invention.

Referring to FIG. 2, downstream three feet from the gas atomizing nozzle 22 was another ⅜ inch copper tube forming a first reactive species injection ring 40 with 80 holes, each having a diameter of 0.029 inch, and having a diameter of 23.5 inches. Argon with 1% oxygen was injected into the spray chamber 12 through this halo to provide the first gaseous reactive species, i.e. oxygen. The argon/oxygen mixture was introduced at a pressure of 200 psig from a mixed gas cylinder. This larger ring 40 also provided a second curtain of gas to push atomized powder away from the wall.

A second reactive species injection ring 50 was located slightly further downstream, at approximately 4.5 feet from the gas atomizing nozzle 22 to inject a second gaseous reactive species (i.e. $SF_6$ gas) in the spray chamber 12. The ring 50 comprised a stainless steel injection ring 50 having the same ring diameter and number of holes as the large gas curtain halo (first injection ring 40). The HP $SF_6$ gas was supplied at a pressure of 3 psig from a pressurized gas cylinder. The holes on the ring were not pointed straight down the chamber, rather at a 45 degree angle towards the middle of the chamber. In this way the gaseous second reactive species (fluorinating gas) would be forced to fill the entire cross-sectional area quickly at the injection level and allowed to react with powders falling through the chamber.

Although this illustrative embodiment of the present invention employs the second injection ring 50 downstream of the first injection ring 40 in the atomization chamber 12, the invention also envisions (in other situations) injecting the first and second reactive species at the same level in the atomization spray chamber 12 with control over the mass flow rates of the gaseous first and second reactive species into the chamber to expose the atomized particles concurrently to the gaseous first and second reactive species in a manner to form the protective layer.

Referring to FIG. 2, attached to the bottom of the spray chamber were a pair of conical reducers that reduced the diameter of the chamber to 1 foot and then 4 inches at the bottom. Powder reaching this point would then pass through an elbow and into a cyclone separator, as shown in FIG. 1. Inside the separator, powders and flake fell to the bottom and the gas exited through the top of the cyclone. Any remaining metal powder after this point was extremely small and was dumped into a wet scrubber.

The atomizer was assembled from the top down using a hoisting system. When complete, the atomizer stood as tall as the ceiling in a high-bay laboratory, about 20 feet tall, and was bolted to support beams on the ceiling. The entire system could be evacuated by a roughing pump to less than 400 milli-torr and then backfilled with HP argon before turning on the crucible induction coil and melting the magnesium charge (99.9% pure magnesium metal). The temperature of the magnesium charge was monitored by two thermocouples which were positioned inside the hollow stopper rod 20 in the middle of the crucible. The stopper rod was pneumatically raised and melt allowed to flow through the pour tube.

For atomizing magnesium, the pour tube orifice was selected to be ¼ inch diameter because there was some concern that the metal might not flow due to the surface tension of magnesium and the relatively small amount of charge being used. A total of 667 g of magnesium were used in crucible 18, which was calculated to provide a maximum of 10 seconds of melt flow, and because of the wider melt stream exiting the pour tube the atomization pressure was increased to 70 psig. The charge was heated to 725° C. to provide some superheat but hsopefully avoid excessive heat which would increase the time needed for powders to cool as they moved through the chamber.

Upon heating the magnesium charge to the target temperature of 725° C., the atomization gas and three gas halos were turned on before pneumatically lifting the stopper rod 20. Molten magnesium metal exited from the pour tube and was immediately impinged by the atomization gas stream from the atomizing nozzle 22. During gas atomization, proper stream break-up will cause the stream to bloom to the edges of the pour tube. If this blooming did not occur immediately, the atomizing nozzle pressure was slowly increased at a gas regulator until the bloom appeared. When the melt flow stopped, the atomization gas and halos were turned off except for the Ar with oxygen halo (injection ring 40), which was allowed to run for another minute. In this way, if the powder had failed to completely oxidize, more oxygen was made available to complete the reaction before opening the atomizer the next day.

Thermocouples were positioned inside the spray chamber 12 using four of the five feed-through ports indicated on FIG. 2, the top feed through was used to install an oxygen sensor that actively monitored the spray chamber during the experiment and also was used after the trial to monitor oxygen levels. Starting from the second feed-through port, from top to bottom of the spray chamber 12, the four thermocouples were located 2, 6, 4, and 8 inches from the chamber wall. These readings were aimed at monitoring the gas temperatures near the wall, then right at the injection of $SF_6$, and two more readings after $SF_6$ injection to estimate the reaction temperature seen by the powders, but were expected to be lower than the actual particle surface temperatures. The stopper rod and outer crucible wall temperatures were monitored by two thermocouples each, one Type C and one Type R at each location. The Type R thermocouples could be monitor by data acquisition software while the Type C thermocouples were read from analog boxes.

After atomization the spray chamber 12 was allowed to cool overnight and the oxygen level was checked again the next morning. As a final precaution, argon with 1% oxygen was flushed through the chamber for another minute in order to oxidize any magnesium metal which may not have been passivated during the atomization run. It was anticipated that the amount of oxygen contained in the argon gas entering the system through the atomizing nozzle and the gas curtain halos during a trial would be sufficient to oxidize all metal surfaces produced before this precautionary step. Disassembly of the chamber was done slowly and with great caution in order to eliminate this danger if it existed and because of the assumed flammability of magnesium powder.

Results:

The following were used to evaluate the atomized magnesium powder sample (designated GA-1-182) produced as described above.

Scanning Electron Microscopy:

Scanning electron microscopy (SEM) served two purposes. First, it was used for identifying areas of interest for auger electron spectroscopy (AES), and because the AES machine has SEM capabilities it was convenient to capture these surface images as well as compositional data. These images served as guides with which to further understand the spectra gathered from AES and to help explain the differences between these spectra. Secondly, SEM was the first indication of whether or not a fluorination reaction had occurred during an experiment. Many of the samples looked similar visually and often had some surface roughness caused by the scraping operations or shrinkage of the samples during cooling. Using the SEM, more subtle differences in surface topography could be observed as well as indications as to the general level of reaction film continuity and porosity. Images were all taken at 10 keV, at magnifications from 50× to 6000× depending on the sample and the features of interest, and using secondary electron imaging (SEI) mode unless otherwise indicated.

Auger Electron Spectroscopy and Depth Profiling:

The most valuable tool for this research was auger electron spectroscopy (AES) because it had the capability of gathering compositional data on the surface of a sample and, using the ion beam gun to etch a sample, it had the ability to generate compositional data going into the sample. The ion beam gun was calibrated using a silica-on-silicon standard to an etching rate of 10 nm/min. All depth profiling data herein was created by converting raw data on etch time versus concentration using this rate calibration factor. A software package called CasaXPS was used for data analysis and refinement.

Raw spectra from AES are useful for identifying the presence of given elements due to inflections in the bond energy curve at given energy levels. Using CasaXPS, these spectra were differentiated so that peak heights for these inflections could be calculated and then turned into semi-quantitative compositional data using a reference relative sensitivity factor (RSF). The RSF values for a each element was taken from a reference manual from Physical Electronics (38) and are shown in Table 1.

TABLE 1

AES relative sensitivity factors

| Element | Mg | O | F | S | N | B | C |
|---|---|---|---|---|---|---|---|
| R.S.F. | 0.109 | 0.22 | 0.513 | 0.652 | 0.161 | 0.105 | 1 |

Using the data points from each etch interval, a curve of an element's composition versus depth into the sample could be compiled. To semi-quantitatively determine the depth of an element, oxygen in the case of an oxide film for example, the point at which the initial atomic percentage of the element was reduced by half was identified. This was said to be the depth at which the particular film or layer had been penetrated and this half maximum rule was used for all depths derived from AES data in this research.

X-ray Photoelectron Spectroscopy:

This technique offered a couple distinct advantages over auger electron spectroscopy (AES). First, X-ray photoelectron spectroscopy (XPS) was used to obtain more accurate compositional data from a few of the samples generated in the Induction Melting Passivation reactor (IMPass). Secondly, XPS irradiates an area of the sample surface instead of a single point. Therefore, the quantization of sample composition represents an average over the area analyzed. The XPS used for this study had a beam area of approximately 1 $cm^2$. This instrument was also capable of performing light etching operations to remove surface contamination which may have built up on samples from handling as all samples were characterized with AES before XPS. Peak heights are converted into relative elemental concentrations using relative sensitivity factors for a specific electron orbital. These values were different from those used in AES and are shown in Table 2.

Powder sample GA-1-182 of the passivated magnesium powder from this Example was taken directly to the XPS after production.

TABLE 2

XPS relative sensitivity factors

| Peak | Mg2s | O1s | F1s | S2p | N1s |
|---|---|---|---|---|---|
| R.S.F | 0.274 | 0.733 | 1.00 | 0.717 | 0.499 |

Flammability Testing:

To verify the effectiveness of the fluorination procedure pursuant to the invention in passivating magnesium powders and making them safer to handle, a flammability test was designed which could be easily repeated and used to comparatively test the ignition temperatures of powder samples. Using a muffle furnace with a programmable temperature control device, a sample of powder could be heated at a controlled rate and monitored for auto-ignition using a type K thermocouple. The steps in the heating program are listed in Table 3. From previous experience with magnesium powders, it was expected that ignition of magnesium powder would occur between 500 and 550° C., so if the powder ignited before the program reached 630° C. the program was held and no more heating took place. For each flammability trial, approximately 0.2 g of powder was placed in a small porcelain crucible with a thermocouple bead directly in the powder throughout the experiment.

The two powders used in this comparative study were −325 mesh gas atomized magnesium powder from Hart Metals, Inc. and a representative sample of powder from the low pressure gas atomization trial GA-1-182. Each was tested twice to verify the onset of ignition temperature.

TABLE 3 flammability test program steps

| Step | Type | Temp. Range (° C.) | Rate (° C./hr) | Time (min) |
|---|---|---|---|---|
| 1 | Ramp | R.T. −200 | 600 | ~20 |
| 2 | Dwell | 200 | — | 6 |
| 3 | Ramp | 200-630 | 900 | 29 |
| 4 | Dwell | 630 | — | 6 |
| 6 | End | — | — | — |

Figure 3:
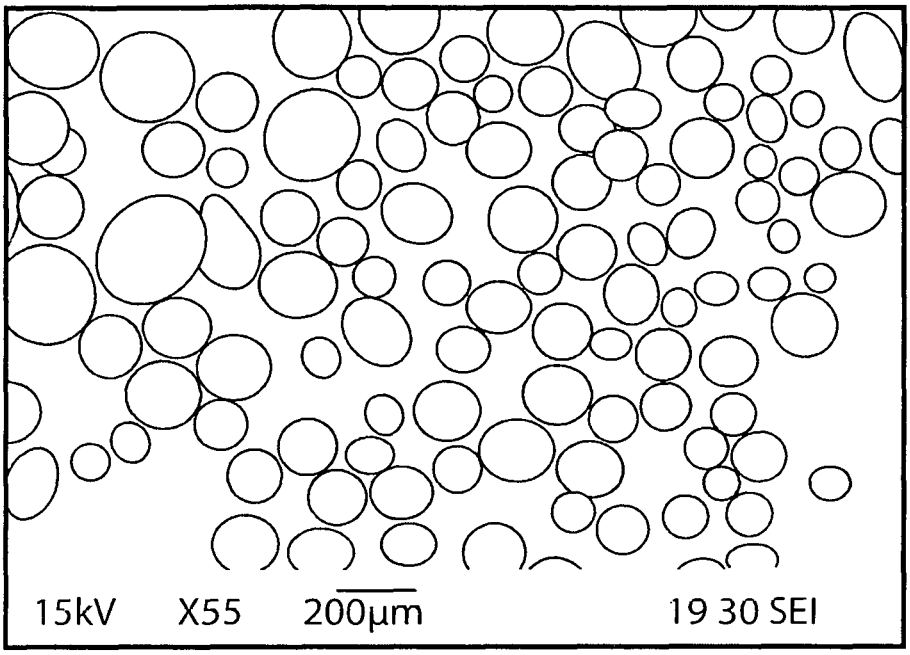
FIG. 3 is a SEM image of spherical powder particles produced by the Example.

Magnesium Atomization Trial Results:

The magnesium atomization trial described above was successful at creating 7 grams of spherical magnesium powder. The majority of the powder was found in the main collection can after the trial and some was caught in the catcher can. The experiment lasted only about one second because the stream froze in the pour tube. The plume of metal could be observed exiting the pour tube, however. It was clear to the observer that the magnesium melt was broken up by the atomization gas immediately and formed powder. The powders produced were very spherical in nature, as shown in FIG. 3 and ranged from >300 μm in diameter to <50 μm. Powder particles were very shiny and exhibited a slightly yellow color to the naked eye. Not enough powder was produced to do any extensive sieving or size analysis of the sample.

Figure 4:
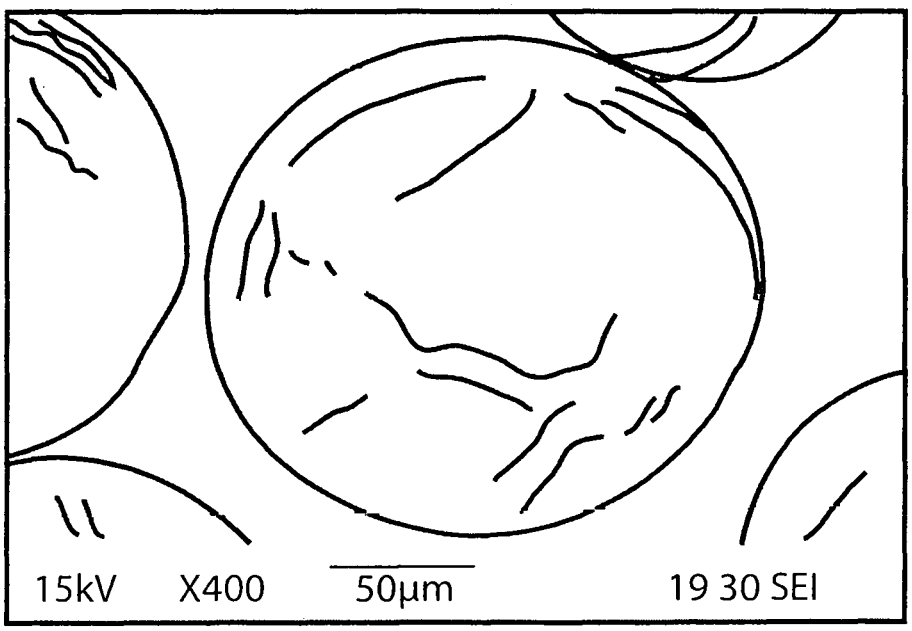
FIG. 4 is a higher magnification SEM image of a spherical powder particle produced by the Example.

FIG. 4 shows one of the magnesium powder particles up close with a continuous and mildly wrinkled reaction product layer covering the entire particle. This appearance of being coated in an outer shell was typical of the powders produced by atomization trial of sample GA-1-182.

Due to the short duration of the magnesium atomization trial, temperature data from the chamber showed only about 1 degree in heating of the atmosphere. Fortunately however, a preliminary gas atomization trial with aluminum as a surrogate for magnesium was conducted at exactly the same parameters (pouring temperature and gas injection halos) as the magnesium trial, but having a run time of about 80 seconds. Thus, it is very likely (referring to FIG. 2) that the temperature of the spray chamber gas that contained the atomized magnesium particles at the first injection ring 40 was approximately 125 degrees C., while the gas temperature that contained the atomized magnesium particles at the second injection ring 50 was approximately 85 degrees C.

Figure 5:
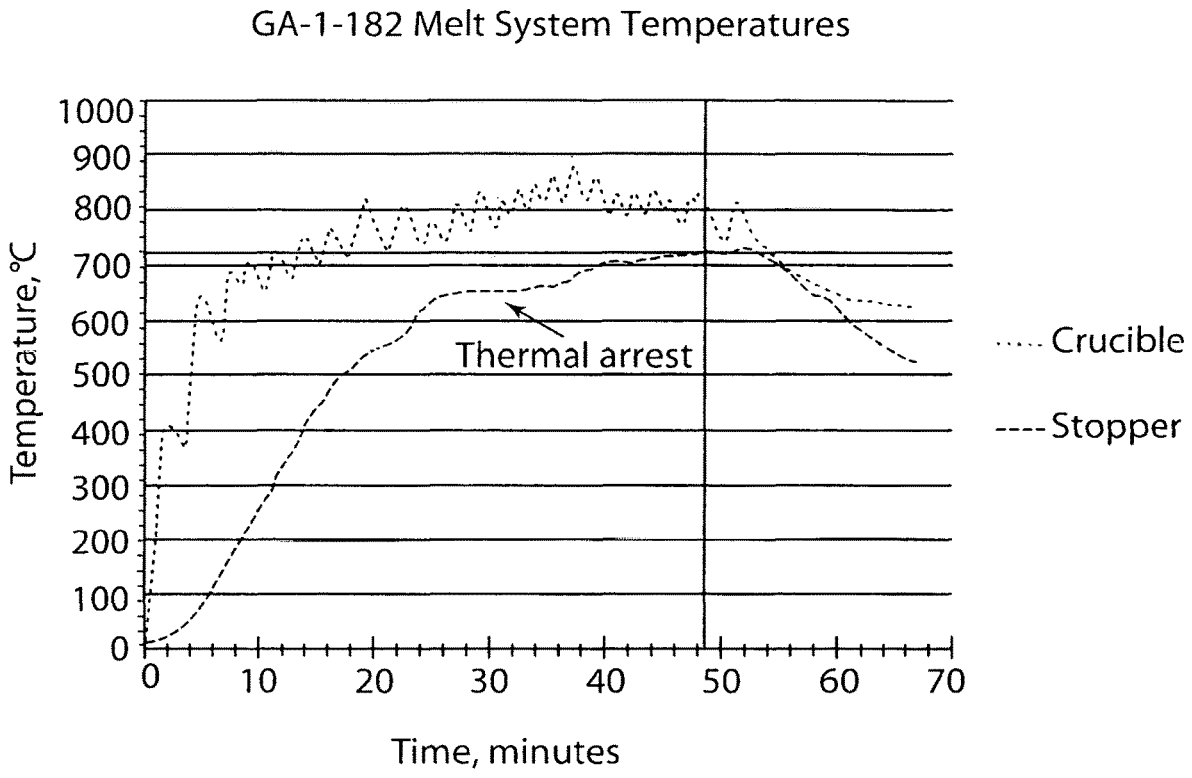
FIG. 5 is a graph of time versus temperature of the melt system.

Oxygen data showed that during the course of the experiment and afterwards the oxygen levels started around 300 ppm and rose to 0.3% after the atomization process. Temperature data was also collected from the crucible wall and stopper rod. The plot in FIG. 5 shows controlled and gradual heating of the magnesium charge by cycling power to the induction coil on and off at regular intervals. This was done because even while idling, the induction coil suscepted extremely well to the steel crucible and it would be possible to heat the crucible well above the boiling point of magnesium, 1091° C., if power was not cycled off periodically. FIG. 5 also illustrates nicely the thermal arrest at 650° C. as the magnesium began to melt hit a plateau for a few minutes. The vertical line represents the time at which the stopper rod was lifted at a temperature of about 725° C.

Figure 6:
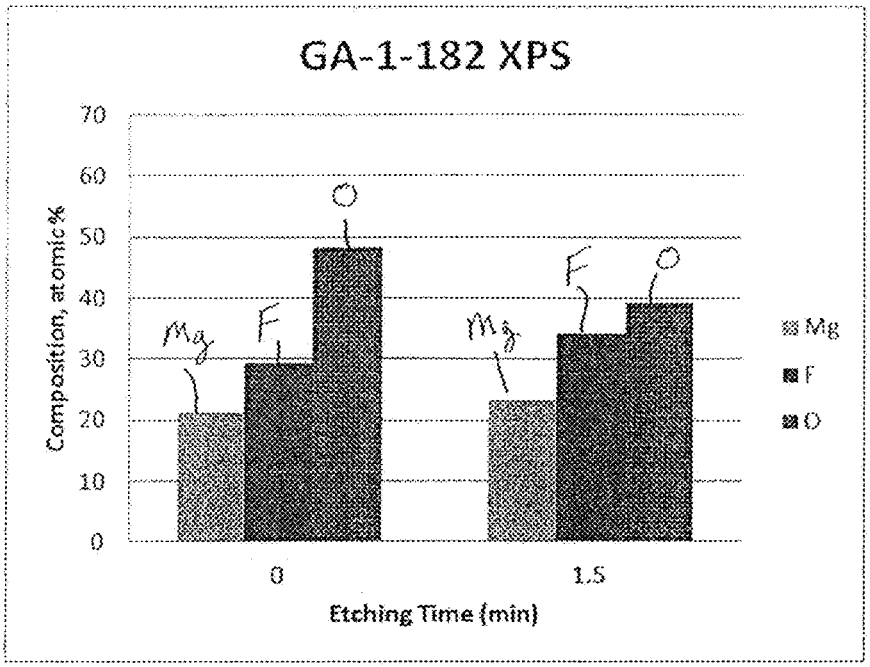
FIG. 6 is XPS data for passivated Mg powders produced by the Example.

X-Ray Photoelectron Spectroscopy:

A sample GA-1-182 of the passivated magnesium powder created by low pressure gas atomization trial example was also examined in the XPS. These results, given in FIG. 6 revealed a high surface fluorine concentration. The surfaces of these powders appeared to be covered in a compound (reaction product) comprising an oxy-fluoride composition with a stoichiometry of $MgFO_2$. Also, because this sample GA-1-182 was taken to the XPS immediately after being produced, no initial cleaning etch was performed and there are only two etch depths shown. It is worth noting that after the 1.5 minute etch, the oxygen level in this sample showed a decline of approximately 9% (atomic). Although a full depth profile analysis of the powder sample could not be completed due to a system breakdown, this result indicates the presence of a very thin reaction film on the powders.

Auger Electron Spectroscopy

Figure 10:
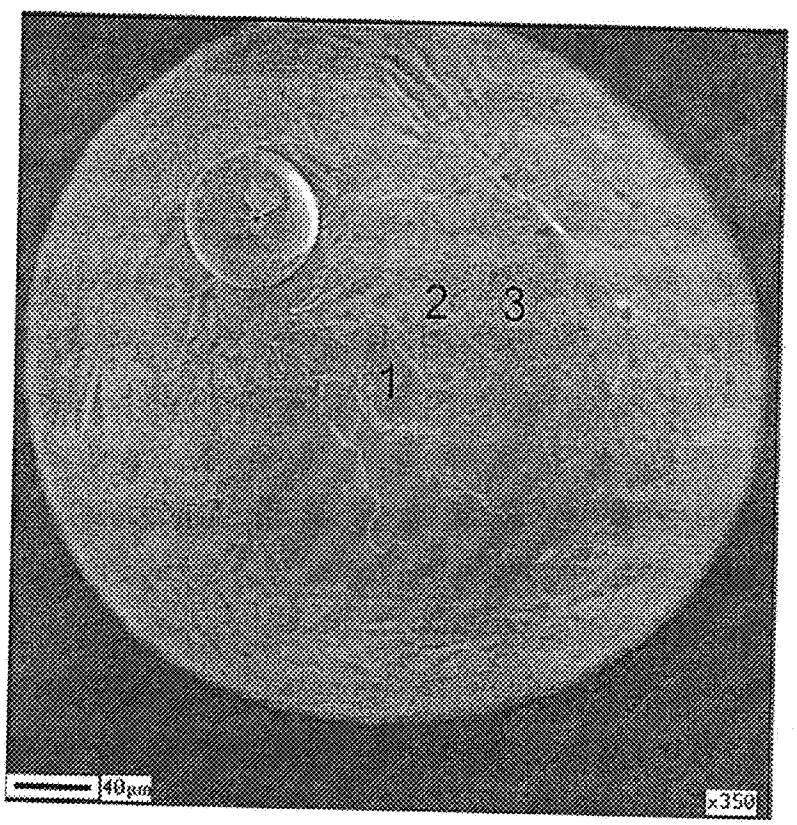
FIGS. 10 and 11 show depth profile of Mg, O, F, and S taken on a large (280 micron) and smaller (110-170 micron) Mg particles produced by the Example and indicating a two-step reaction using the first and second gaseous reactive species.
Figure 10:
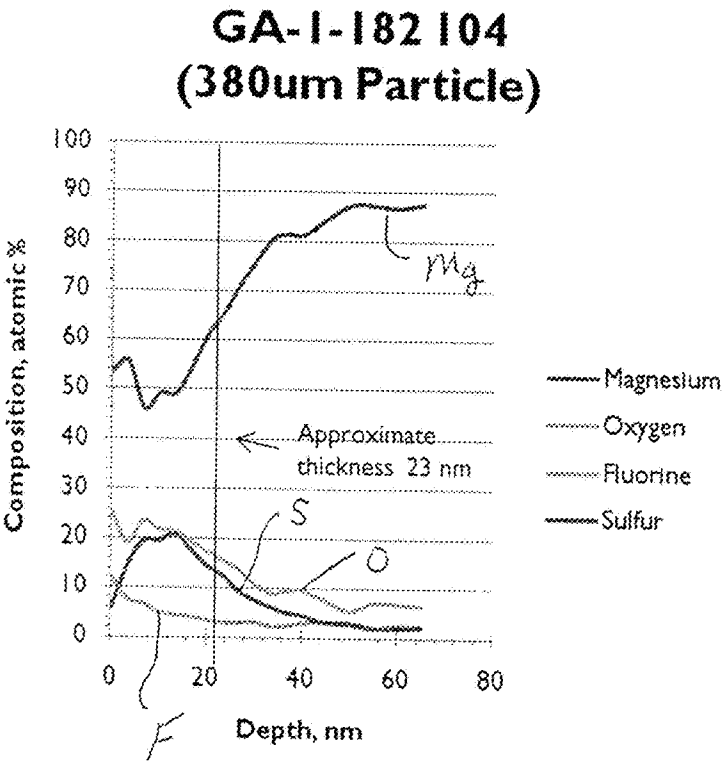
Figure 11:
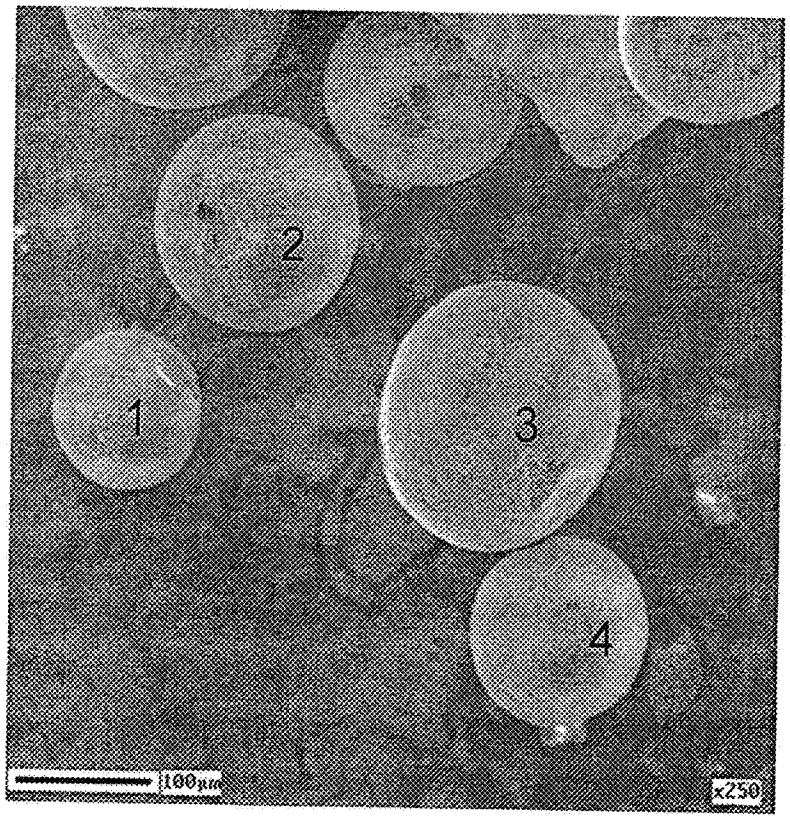
Figure 11:
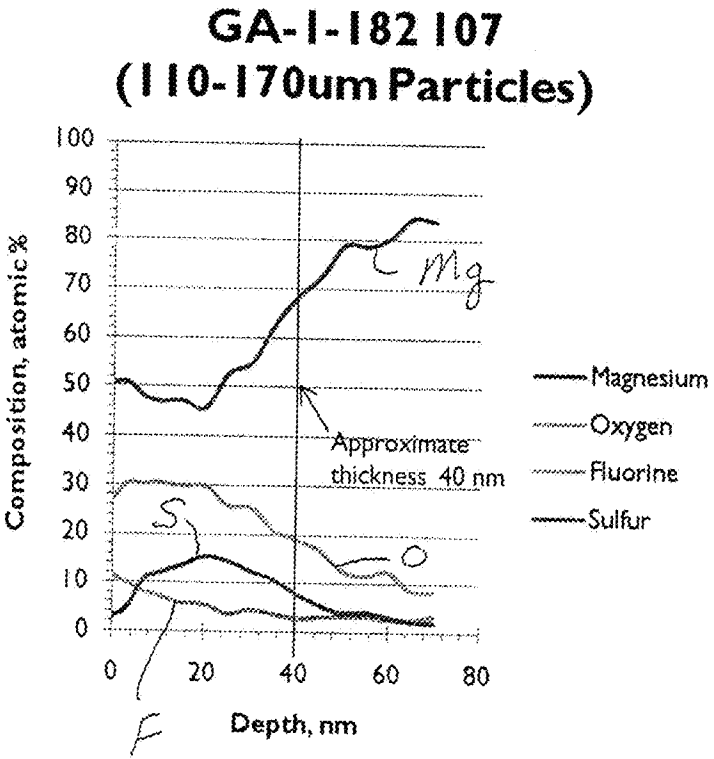

FIGS. 10 and 11 show depth profile of Mg, O, F, and S taken on a large (280 micron) and smaller (110-170 micron) Mg particles produced by the Example. FIGS. 10 and 11 clearly show O, S, and F contents in the powders. Oxygen depths exceed fluorine depths into the powder, indicating a two-step reaction has taken place on the particle surface. Depth profiles were averaged from three readings (FIG. 10) or four readings (FIG. 11) taken from approximate locations shown in adjacent micrographs.

Fluorination depths of these samples were up to 40 nm. These depths are far thinner than those measured for heavily oxidized areas of the magnesium samples and suggest that the fluorination reaction does not proceed entirely through the oxide layer, possibly as a result of a barrier to diffusion being formed through fluorination. This could have to do with the reaction temperature and cooling rate of the sample as well. In the low pressure gas atomization (LPGA) case, the powders have much shorter timeframes during which to react with a passivating gas mixture, reducing the fluorination depth. A thinner fluorination depth is considered desirable as long as the layer is protective against oxidation. A thin modified oxide layer also minimizes the fluorine content of the resulting metal powders produced, reducing impact on the desired composition of the powders.

Figure 7:
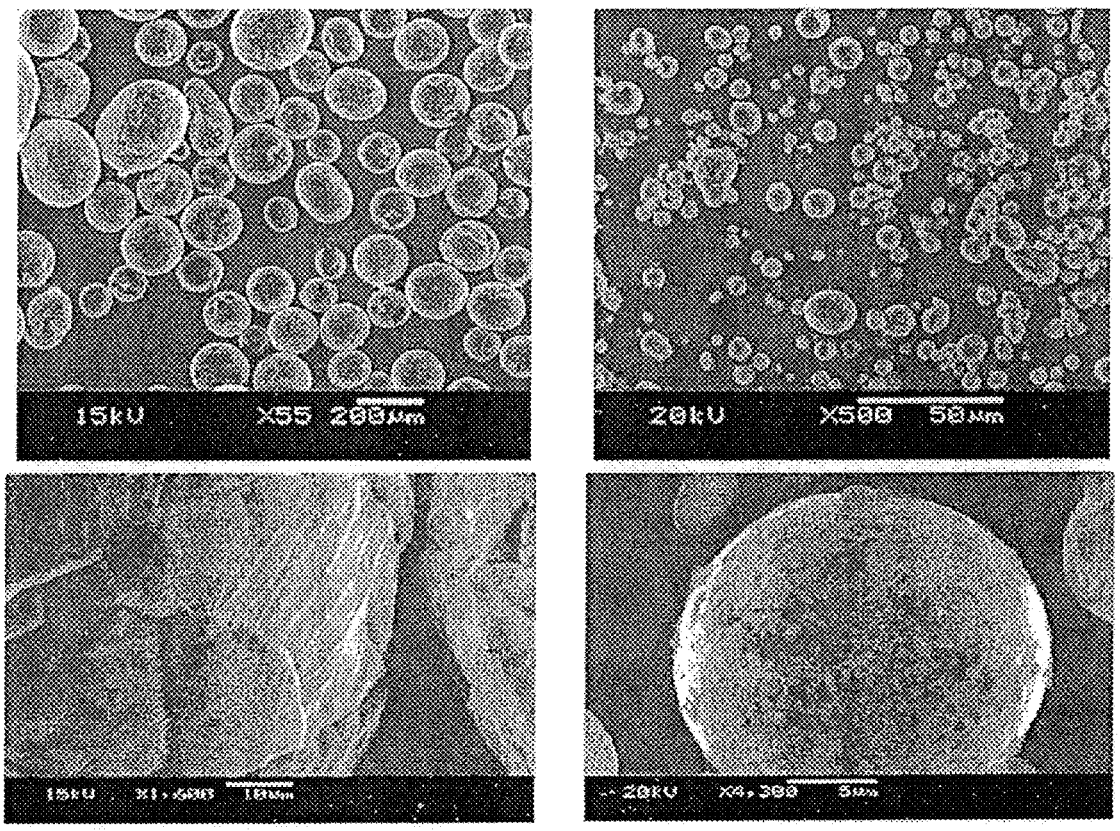
FIG. 7 contains SEM images of passivated Mg powder produced by the Example (left column) and comparison commercially available Mg powder (right column).

Flammability Testing:

Flammability testing was conducted using a muffle furnace and the temperature program described in Table 3 so that the magnesium powders produced by LPGA could be compared to magnesium powder which was commercially available on the market. FIG. 7 offers a direct comparison of the size and shape of the powders used for this testing. The commercially available magnesium powder was less than 63 μm in diameter while the GA-1-182 powder ranged from 100-300 μm. Some finer size passivated magnesium powder was produced, but not in any appreciable amount which could be used for a flammability test.

Higher magnification SEM images of the powders included in FIG. 7 reveal the drastic difference in surface topography that resulted from passivation. At 1,600× the passivated powder surface of sample GA-1-182 shows clearly the presence of a wrinkled and continuous film covering the entire surface of the powder. This layer even bridges grain boundaries and irregular geometries on the powder surface. In contrast, even at 4,300× the commercially available powder shows no evidence of such a film covering the entire surface of the powder particle.

Figure 8:
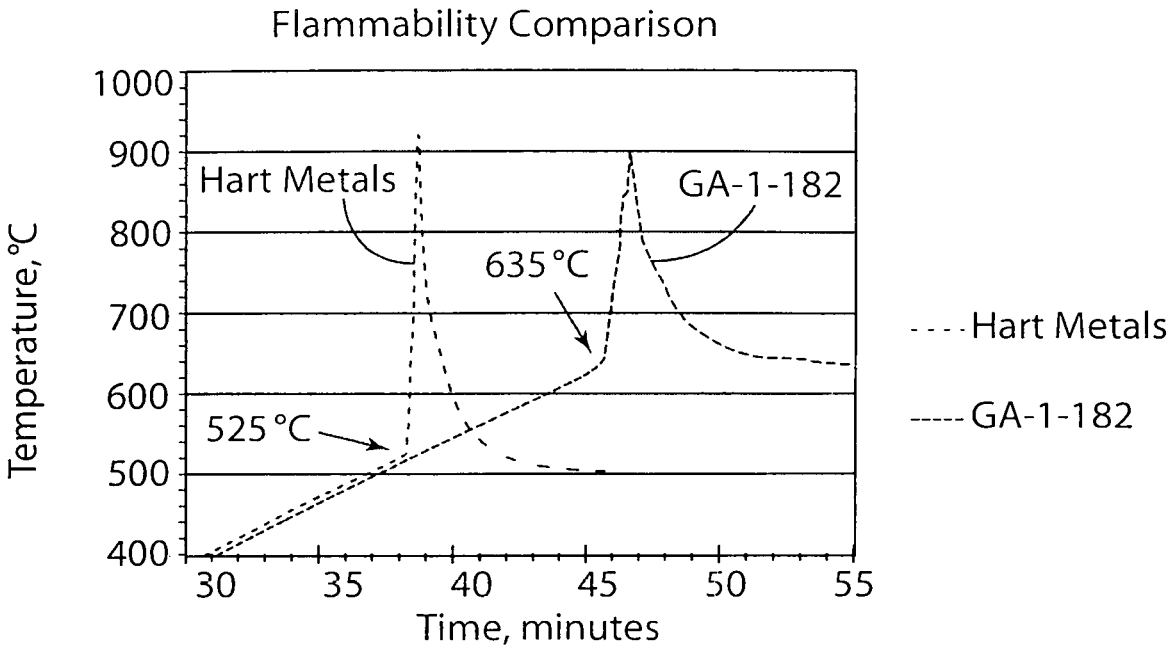
FIG. 8 is a graph of the flammability test results for bulk powder produced by the Example compared to commercially available Mg powders.

It was found that the novel passivation technique utilizing $SF_6$ as a means of modifying the behavior of magnesium's native oxide had a significant impact on the onset of magnesium powder ignition. The powder purchased commercially showed a rapid exotherm at approximately 525° C., ramping above 920° C. in just seconds, FIG. 8. On the other hand, GA-1-182 passivated powder did not ignite until 635° C. FIG. 8 illustrates this difference in ignition temperatures and reveals a difference in the overall shape and height of the exotherm peaks generated by the two samples. It is likely that variations in peak shape arose from differences in the powder size distributions and sample weights.

Figure 9:
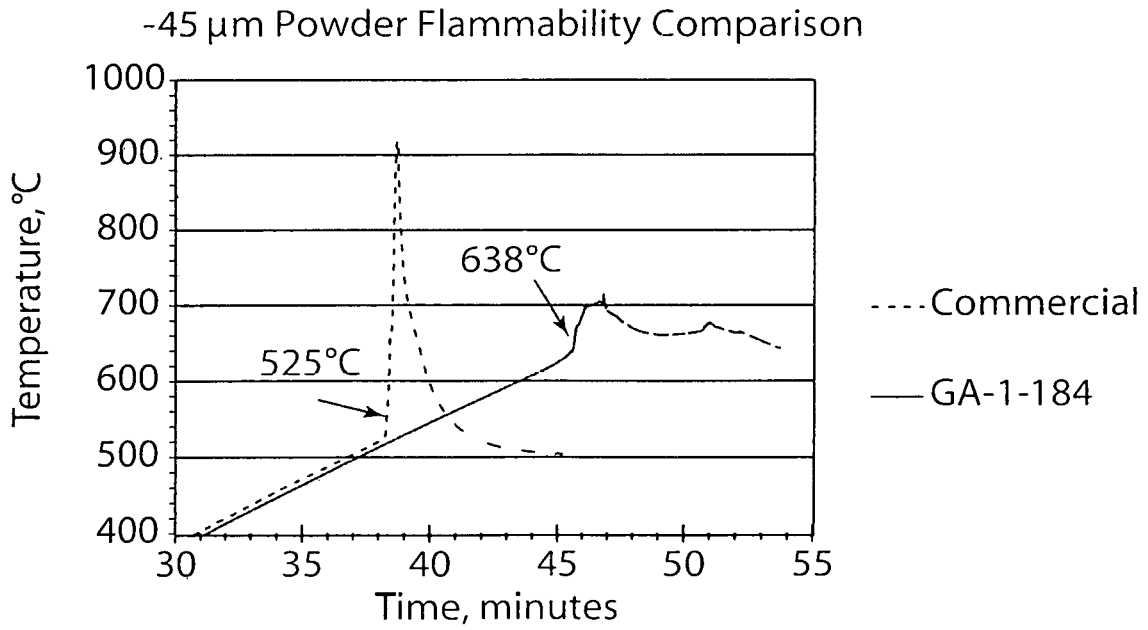
FIG. 9 is a graph of the flammability test results for −45 micron (sieved) powder produced by the Example compared to commercially available Mg powders.

FIG. 9 shows the results of a flammability test for sieved −45 micron passivated powders GA-1-182 versus the commercially available magnesium powder. While the commercial powder ignited and showed a significant heat rise at 525° C., the fluorinated powders GA-1-182 did not ignition until 638° C. This is quite close to the actual melting temperature of magnesium, 650° C. Both samples were observed to be completely converted to white magnesium oxide after testing. The differences in peak areas can be attributed to the fact that the fluorinate sample was 0.1 g, compared to 0.2 g of commercial powder, thus producing less heat upon ignition. Also, the small secondary peak in the fluorinated powder temperature profile was probably the result of a second ignition caused by a small, separate cluster of powder particles which did not burn when the initial pile burned.

Spark Testing:

Magnesium powder was further tested to confirm the passivation of the powders GA-1-182 produced. A small (about 0.5 g) representative sample of the powder produced was subjected to a Tesla coil spark test which involved sparking of the powder mound resting on a stainless steel sheet to determine the reactivity of atomized powders. Fluorinated magnesium powders GA-1-182 showed no response to this spark test. That is, the sample did not ignite.

A −45 um diameter sample of the fluorinated powder was obtained by sieving and compared directly to a −45 um diameter sample of commercial powder which was presumed to have a magnesium oxide coating. Again, the −45 micron fluorinated powder GA-1-182 did not react (did not ignite) to the spark, but the commercial powder immediately ignited. The commercially available sample exhibited initial ignition followed by eventual full conversion of the magnesium to magnesium oxide powder, apparently.

The effectiveness of the present invention in passivating magnesium powders GA-1-182 and making them safer to handle was demonstrated clearly by both the flammability test and the spark test.

Although the present invention has been described in connection with certain embodiments, those skilled in the art will appreciate that changes and modifications can be made therein with the scope of the invention as set forth in the appended claims.

References, which are incorporated herein by reference:

1. Fruehling, J. W. *Protective Atmospheres for Molten Magnesium*. PhD Thesis: University of Michigan, 1970.
2. *Characterisation of protective surface films formed on molten magnesium protected by air/SF6 atmospheres*. Cashion, S. P., Ricketts, N. J. and Hayes, P. C. Kenmore, Australia: Journal of Light Metals 2, 2002.
3. *Characterisation of the surface films formed on molten magnesium in different protective atmospheres*. Pettersen, Gunnar, et al. Trondheim, Norway: Materials Science and Engineering A332, 2002.
4. Sokolowski, Peter. *Processing and protection of rare earth permanent magnet particulate for bonded magnet applications*. PhD Thesis: Iowa State University, 2007.
5. Russell, Alan M. and Lee, Kok Loong. *Structure-Property Relations in Nonferrous Metals*. Iloboken, N.J.: John Wiley & Sons, Inc., 2005. 0-471-64952-X.
6. Magnesium FAQ. *International Magnesium Association*. [Online] 2010. http://www.intlmag.org/faq.html.
7. Magnesium Statistics. *International. Magnesium Association*. [Online] 2010. http://www.intlmag.org/statistics.html.
8. StrikoDynarad Corporation. *Safe Handling of Magnesium*. Zeeland, Mich.: StrikoWestofen Company, March 2010.
9. Elektron, Magnesium. Magnesium Elektron. *Atomised Magnesium Powders*. [Online] http://www.magnesium-elektron.com/data/downloads/345atomisedpowders.pdf.
10. Valimet, Inc. *Preliminary Design of Plant for Spherical Magnesium Powder*. Stockton, Calif.: Valimet, Inc., 1996.
11. *Behaviour of CaO coatings of gas atomized Mg powders using mechanical milling process*. Kim, Sun-Mi, et al. Seoul, Korea: Journal of Alloys and Compounds 509S, 2011.
12. *The Oxidation of Metals at High Temperatures*. Pilling, N. B. and Bedworth, R. E. East Pittsburgh, Pa.: Journal of the Institute of Metals, 1923.
13. *The Oxidation and Evaporation of Magnesium at Temperatures from* 400 *to* 500 *C*. Gulbransen, Earl A. s.l.: Symposium on Electrometallurgy, 1944.
14. Kubaschewski, O. and Hopkins, B. E. *Oxidation of Metals and Alloys*. s.l.: Academic Press, 1953. 1-11418-617-0.
15. *Rates of High-temperature Oxidation of Magnesium and Magnesium Alloys*. Leontis, T. E. and Rhines, F. N. s.l.: Metals Technology, 1946.
16. *The High-temperature Oxidation of Magnesium in Dry and in Moist Oxygen*. Gregg, S. J. and Jepson, W. B. Exeter, UK: Journal of the Institute of Metals, 1958.
17. Reimers, Hans A. *Method for Inhibiting the Oxidation of Readily Oxidizable Metals*. 1,972,317 Midland, Mich., USA, Jun. 17, 1932.
18. *The Mechanism of Protection of Molten Magnesium by Cover Gas Mixtures Containing Sulfur Hexafluoride*. Cashion, S. P., Ricketts, N. J. and Hayes, P. C. Kenmore, Australia: Journal of Light Metals 2, 2002.
19. *Protection Behavior of Fluorine-containing Cover Gases on Molten Magnesium Alloys*. Xiong, Shou-mei and Wang, Xian-fei. Beijing, China: Transactions of Nonferrous Metals Society of China 20, 2010.
20. Nations, United. *Kyoto Protocol to the United Nations Framework Convention on Climate Change*. Kyoto, Japan: United Nations, 1998.
21. Hillis, James E. *The International Program to Identify Alternatives to SF6 for Magnesium Melt Protection*. s.l.: International Magnesium Association, 2002.
22. European Union. *Directive* 2006/40/*EC fo the European Parliament and of the Council*. Strasbourg: Official Journal of the European Union, 2006.
23. *Thermal Decomposition of NF*3 *with Various Oxides*. Vileno, Elizabeth, et al. Storrs, Conn.: Chemical Materials, 1995, Vol. 8.
24. Anderson, I. E., Terpstra, R. L. and Figliola, R. S. *Visualization of Enhanced Primary Atomization for Powder Size Control*. Princeton, N.J.: Advances in Powder Metallurgy and Particulate Materials, 2005.
25. *Atomization: The Production of Metal Powders*. Lawley, A. Princeton, N.J.: MPIF, 1992.
26. *Evaluating the Performance of Atomizers*. Dunkley, J. J. Princeton, N.J.: Advances in Powder Metallurgy and Particulate Materials, 1989, Vol. 2.
77 *Highly Tuned Gas Atomization for Controlled Preparation of Coarse Powder*. Anderson, I. E., Byrd, D. and Meyer, J. 7, s.l.: Materialwissenschaft and Werkstofftechnik, 2010, Vol. 41.
28. Gaskell, David R. *Introduction to the Thermodynamics of Materials—Fourth Edition*. New York, N.Y.: Taylor & Francis Group, 2003. 2-901560-329922.
29. Binnewies, M. and Milke, E. *Thermochemical Data of Elements and Compounds*. Weinheim, Germany: Wiley-VCH, 1999. 3-527-29775-8.
30. Barin, I., Knacke, O. and Kubaschewski, O. *Thermochemical Properties of Inorganic Substances*. Berlin, Germany: Springer-Verlag, 1973. 3-540-06053-7.
31. *Analysis of the Spray Deposition Process*. Mathur, P., Apelian, D. and Lawley, A. 2, Philadelphia, Pa.: Acta Metallurgica, 1988, Vol. 37.
32. Poirier, D. R. and Geiger, G. H. *Transport Phenomena in Materials Processing*. Warrendale, Pa.: The Minerals, Metals & Materials Society, 1994.
33. Incropera, Frank P., et al. *Introduction to Heat Transfer*. s.l.: Wiley, 2006. 0-4714-5727-2.
34. DuPont Chemical Company. *DuPont Krytox Performance Lubricants Product Overview*. United States of America: DuPont, 2011.
35. *DuPont Krytox Performance Lubricants Typical Properties*. United States of America: DuPont, 2011.
36. PHI Physical Electronics, Inc. *MultiPak Software Manual Version* 5.0 *Part No*. 638366 *Rev. B*. Eden Praire, Minn.: Physical Electronics, Inc., 1998.
37. Braker, William and Mossman, *Allen L. Matheson Gas Data Book Sixth Edition*. Secaucus, N.J.: Mathcson Gas Products, 1980. 3-2792-002-830-333.
38. Wolfe, Joe and Smith, John. The University of New South Wales Faculty of Science. *Physics in Speech*. [Online] 2005. [Cited: Nov. 16, 2011.] http://phys.unsw.edu.au/phys_about/PHYSICS!/SPEECH_HELIUM/speech.html.

We claim:

1. Apparatus for atomizing a metallic material, comprising an atomizing nozzle for atomizing a molten metallic material to form a spray of atomized particles in a chamber, a first gas injector for discharging a gaseous first reactive species comprising an oxygen-bearing gas into the chamber to provide a first reaction zone in the chamber, a source of oxygen-bearing gas communicated to the first gas injector, a second gas injector for discharging a gaseous second reactive species comprising a halogen-bearing gas into the chamber to provide a second reaction zone in the chamber, and a source of halogen-bearing gas communicated to the second gas injector.

2. The apparatus of claim 1 wherein the atomizing nozzle is a close-coupled nozzle.

3. The apparatus of claim 1 wherein the second gas injector is disposed downstream of the first gas injector.

4. The apparatus of claim 1 including a source of oxygen-bearing inert gas for supply to the first gas injector and a source of a fluorine-bearing gas for supply to the second gas injector.

5. The apparatus of claim 1 wherein the second gas injector includes a plurality of gas discharge openings pointed downwardly and angled toward the middle of the chamber.

6. The apparatus of claim 1 including an oxygen sensor for monitoring oxygen level in the chamber.

* * * * *